US007165532B2

(12) United States Patent
Steffes et al.

(10) Patent No.: US 7,165,532 B2
(45) Date of Patent: Jan. 23, 2007

(54) ENGINE SPEED CONTROL WITH HIGH SPEED OVERRIDE MECHANISM

(75) Inventors: Kevin D. Steffes, Fond du Lac, WI (US); Timothy D. Taylor, Sheboygan, WI (US); Daniel L. Schneider, Kiel, WI (US)

(73) Assignee: Tecumseh Products Company, Tecumseh, MI (US)

( * ) Notice: Subject to any disclaimer, the term of this patent is extended or adjusted under 35 U.S.C. 154(b) by 6 days.

(21) Appl. No.: 11/014,499

(22) Filed: Dec. 16, 2004

(65) Prior Publication Data

US 2006/0130808 A1 Jun. 22, 2006

(51) Int. Cl.
*F02D 31/00* (2006.01)
*F02D 1/00* (2006.01)

(52) U.S. Cl. ..... 123/376; 123/400

(58) Field of Classification Search ..... 123/376, 123/400, 403

See application file for complete search history.

(56) References Cited

U.S. PATENT DOCUMENTS

| | | | | |
|---|---|---|---|---|
| 3,596,642 | A * | 8/1971 | Nakata | 123/584 |
| 3,669,084 | A * | 6/1972 | Cook | 123/512 |
| 3,685,501 | A * | 8/1972 | Honda | 123/378 |
| 3,960,130 | A * | 6/1976 | Peterson, Jr. | 123/179.18 |
| 4,056,082 | A * | 11/1977 | Noiles | 123/339.16 |
| 4,108,120 | A | 8/1978 | Woelffer | 123/103 B |
| 4,517,942 | A | 5/1985 | Pirkey et al. | 123/376 |
| 4,524,740 | A | 6/1985 | Brockhaus | |
| 4,620,575 | A | 11/1986 | Cuba et al. | 180/307 |
| 4,643,148 | A | 2/1987 | Jedrziewski | 123/376 |
| 4,727,837 | A | 3/1988 | Sturdy | |
| 4,773,371 | A | 9/1988 | Stenz | 123/376 |
| 4,938,304 | A | 7/1990 | Yamaguchi et al. | 180/197 |
| 5,040,508 | A | 8/1991 | Watanabe | |
| 5,163,401 | A | 11/1992 | Reese | 123/376 |
| 6,014,954 | A | 1/2000 | Kleeman et al. | 123/339.13 |
| 6,039,024 | A | 3/2000 | Carlson et al. | 123/396 |
| 6,439,547 | B1 | 8/2002 | King et al. | 261/52 |
| 6,523,525 | B1 | 2/2003 | Hawkins | |
| 6,666,187 | B2 | 12/2003 | Dahlberg et al. | 123/398 |
| 6,729,298 | B1 | 5/2004 | Sterr | 123/339.13 |
| 2002/0088431 | A1 | 7/2002 | Dahlberg et al. | 123/400 |
| 2004/0035394 | A1 | 2/2004 | Gerhardy | 123/400 |

FOREIGN PATENT DOCUMENTS

| | | |
|---|---|---|
| DE | 39 37 846 | 5/1991 |

* cited by examiner

*Primary Examiner*—John T. Kwon
(74) *Attorney, Agent, or Firm*—Baker & Daniels LLP

(57) ABSTRACT

A secondary engine speed control mechanism for small internal combustion engines, including an operator control which is manually operable to override an engine running speed which is set by the engine's primary speed control mechanism and governed by the governor. The secondary speed control mechanism may be selectively actuated by the operator in anticipation of an increased engine load to provide a temporary increase or "boost" to engine speed above the set, governed engine running speed. The secondary speed control mechanism may include an operator actuated, trigger-type mechanism located on the handle of an implement with which the engine is used.

23 Claims, 6 Drawing Sheets

ENGINE SPEED CONTROL WITH HIGH SPEED OVERRIDE MECHANISM

BACKGROUND OF THE INVENTION

1. Field of the Invention

The present invention relates to small internal combustion engines of the type used with lawnmowers, lawn tractors, other utility implements, and in sport vehicles, for example. In particular, the present invention relates to speed control mechanisms for such engines.

2. Description of the Related Art

Small internal combustion engines typically include a carburetor which supplies an air/fuel mixture to one or more combustion chambers of the engine for combustion to drive the piston(s) and the crankshaft of the engine. The engine speed is typically regulated by a throttle valve disposed within the intake passage of the carburetor, which is movable between a substantially closed position corresponding to the engine being stopped or the engine running at a low or idle speed, and a substantially open position, corresponding to the engine running at its running speed.

Many small internal combustion engines also include a governor for maintaining a desired running speed of the engine, including a mechanical governor mechanism disposed within the crankcase and driven from the crankshaft. The governor mechanism may include one or more flyweights movable responsive to engine speed, which actuate a governor arm with the crankcase and a governor lever disposed externally of the crankcase. The governor lever is linked to the throttle valve of the carburetor. In operation, when the engine speed falls below a desired running speed, such as when a load is imposed upon the engine, the governor operates to further open the throttle valve of the carburetor to increase the engine speed. When the engine speed increases beyond a desired running speed, such as when a load is removed from the engine, the governor operates to further close the throttle valve of the carburetor to decrease the engine speed.

Many small internal combustion engines also include a speed control mechanism which is operable by an operator to set the running speed of the engine. The speed control mechanism includes a speed control lever which may be disposed either near the engine itself, or on the handle of an implement with which the engine is used. The speed control lever is movable between stop, idle, and various running speed positions, for example, to set the engine speed. When the speed control lever is disposed in the stop position, the throttle valve of the carburetor is substantially fully closed. When the speed control lever is disposed in the idle position, the throttle valve of the carburetor is slightly open to maintain a low engine running speed. When the speed control lever is moved through the various running speed positions toward a high speed position, the throttle valve is progressively opened to provide progressively higher engine running speeds. When the throttle lever is positioned to establish a desired running speed, that running speed is maintained by the governor responsive to engine load in the manner described above.

One disadvantage of the foregoing speed control arrangement is that if a load is imposed upon the engine, such as by a lawnmower encountering tall grass or a snow thrower encountering deep or heavy snow, for example, there is often a time lag between the imposition of the load and decrease in engine speed, and the response of the governor to correct for the underspeed and bring the engine speed back up to the desired running speed. Conversely, when a load is removed from the engine, there is often a time lag between the removal of the load and increase in engine speed, and the response of the governor to correct for the overspeed and bring the engine speed back down to the desired running speed. Notably, even if the operator anticipates the variation in load which is imposed upon the engine, the operator cannot easily vary the engine speed, but must wait for the governor to correct the engine speed after the load is imposed or after the load is removed.

What is needed is a speed control mechanism for small internal combustion engines which is an improvement over the foregoing.

SUMMARY OF THE INVENTION

The present invention provides a secondary engine speed control mechanism for small internal combustion engines, including an operator control which is manually operable to override an engine running speed which is set by the engine's primary speed control mechanism and governed by the governor. The secondary speed control mechanism may be selectively actuated by the operator in anticipation of an increased engine load to provide a temporary increase or "boost" to engine speed above the set, governed engine running speed. The secondary speed control mechanism may include an operator actuated, trigger-type mechanism located on the handle of an implement with which the engine is used.

In one embodiment, the engine includes a primary speed control mechanism which operates through linkage including the governor lever for setting a desired, set and governed engine running speed, and a second speed control mechanism for allowing the operator to override the set running speed to temporarily increase the engine speed. The secondary speed control mechanism includes a cable-actuated lever which engages a throttle actuation lever of the primary speed control mechanism to move the throttle valve of the carburetor to its fully open position via the primary speed control linkage.

In another embodiment, the engine includes a primary speed control mechanism connected to the governor lever of the engine for allowing the operator to set a desired, set and governed running speed of the engine, and a secondary speed control mechanism which is independently attached to the governor lever to allow the operator to override the primary speed control mechanism to temporarily increase the running speed of the engine. The second speed control mechanism includes an actuator device mounted to the engine housing, including a translatable, cable-actuated plunger connected to the governor lever via a spring link to rotate the governor lever and move the throttle valve of the carburetor to its fully open position.

Each of the embodiments disclosed herein advantageously allow the operator of a small internal combustion engine to manually override a set and governed running speed of the engine to provide a quick increase or "boost" to the engine speed above the set and governed running speed, such as when the operator anticipates an increased engine load. For example, an operator of a snow thrower with which the engine is used may temporarily increase the engine speed when encountering thick or heavy snow, or an operator using a lawnmower with which the engine is used may temporarily increase the engine speed when encountering thick or tall grass.

In one form thereof, the present invention provides an internal combustion engine, including an engine housing including a rotatably driven crankshaft supported therein; a carburetor including an intake passage with a throttle valve therein, the throttle valve positionable between a substantially closed position, a substantially open position, and a fully open position; a primary speed control mechanism including a first operator control element mechanically linked to the throttle valve, the first operator control element movable to selectively position the throttle valve between the substantially closed and the substantially open positions; and a secondary speed control mechanism including a second operator control element mechanically linked to the throttle valve, the second operator control element movable to selectively position the throttle valve between the substantially open and the fully open positions.

In another form thereof, the present invention provides an internal combustion engine, including a crankcase; a cylinder block attached to the crankcase; a crankshaft rotatably supported by the crankcase; a carburetor including an intake passage with a throttle valve, the throttle valve rotatable within the intake passage between a substantially closed position, a substantially open position, and a fully open position; a primary speed control mechanism including a first operator control element connected to the throttle valve via mechanical linkage, the first operator control element movable to selectively position the throttle valve between the substantially closed and the substantially open positions; and speed control override means for actuating at least some components of the mechanical linkage to selectively position the throttle valve between the substantially open and the fully open positions.

In a further form thereof, the present invention provides an internal combustion engine, including an engine housing including a crankcase and a cylinder block; a crankshaft rotatably supported by the crankcase; a carburetor including an intake passage with a throttle valve therein; a governor mechanism driven from the crankshaft, including a governor arm disposed externally of the engine housing and mechanically linked to the throttle valve, the governor arm and the throttle valve positionable between a first position in which the throttle valve is substantially closed, a second position in which the throttle valve is substantially open, and a third position in which the throttle valve is fully open; a primary speed control mechanism including a first operator control element mechanically linked to the governor arm by primary linkage, the first operator control element movable to selectively position the governor arm and throttle valve between the first and second positions; and a secondary speed control mechanism including a second operator control element mechanically linked to an actuator by secondary linkage, the second operator control element movable to engage the actuator with the primary speed control mechanism to selectively position the governor arm and throttle valve between the second and third positions.

In a still further form thereof, the present invention provides an internal combustion engine, including an engine housing including a crankcase and a cylinder block; a crankshaft rotatably supported by the crankcase; a carburetor including an intake passage with a throttle valve therein; a governor mechanism driven from the crankshaft, including a governor arm disposed externally of the engine housing and mechanically linked to the throttle valve, the governor arm and the throttle valve positionable between a first position in which the throttle valve is substantially closed, a second position in which the throttle valve is substantially open, and a third position in which the throttle valve is fully open; a primary speed control mechanism including a first user control element mechanically linked to the governor arm, the first operator control element movable to selectively position the governor arm and the throttle valve between the first and second positions; and a secondary speed control mechanism including a second user control element mechanically linked to the governor arm independently of the primary speed control mechanism, the second operator control element movable to selectively position the governor arm and the throttle valve between the second and third positions.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrate preferred embodiments of the invention, and such exemplifications are not to be construed as limiting the scope of the invention any manner.

DETAILED DESCRIPTION

Figure 1:
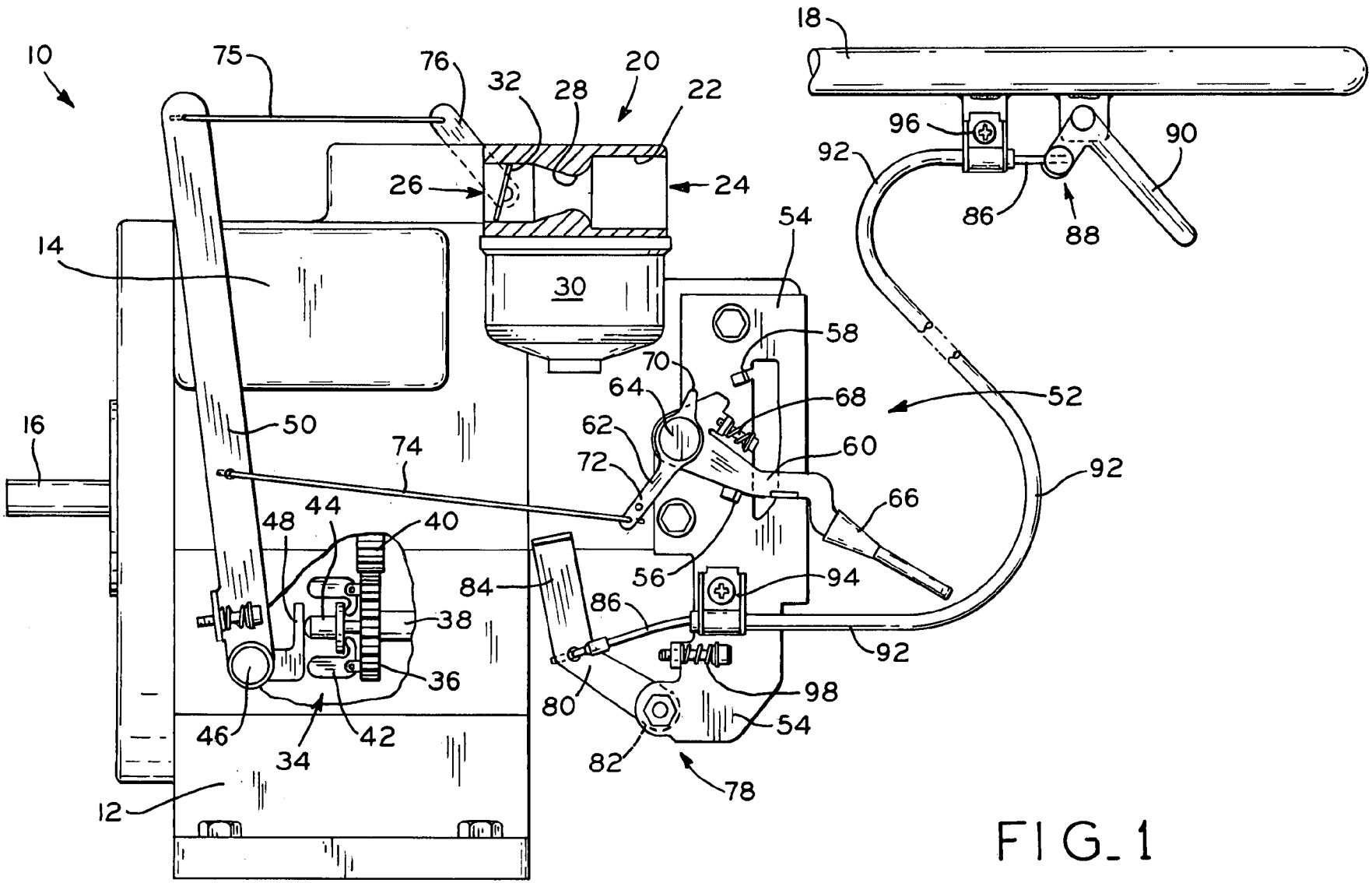
FIG. 1 is a perspective view of portions of a small internal combustion engine showing a primary speed control mechanism operably linked to the governor lever and carburetor of the engine and disposed in an engine stop position, a secondary speed control mechanism according to a first embodiment of the present invention, the secondary speed control mechanism in a non-actuated position, and also showing a portion of the engine crankcase cut away to show components of the governor mechanism.

Referring to FIG. 1, portions of a small, single or two-cylinder internal combustion engine 10 are shown, the engine including a primary speed control mechanism and a secondary, high speed override speed control mechanism according to the present invention. Engine 10 includes crankcase 12 and cylinder block 14 attached to crankcase 12, with cylinder block 14 including one or more bores which receive pistons (not shown). Each piston is connected to crankshaft 16 of engine 10 via a connecting rod (not shown). Engine 10 is shown herein as a horizontal crankshaft engine; however, the present invention is equally applicable to vertical crankshaft engines. Engine 10 is of the type used with utility implements such as snow throwers, lawnmowers, and other utility implements, for example, the implement typically including a frame (not shown) to which engine 10 is attached, and a handle 18 extending from the frame which may be grasped by an operator to maneuver the implement. For example, when the implement is a snow thrower, engine 10 is mounted to a deck (not shown) which includes two or more wheels, and engine 10 drives an impeller mechanism. When engine 10 is used with a lawnmower, engine 10 is mounted to a deck (not shown) including wheels, and engine 10 drives a rotating cutting blade beneath the deck.

Engine 10 includes a carburetor 20 connected to engine 10 in fluid communication with the combustion chamber(s) of the engine cylinder(s) to supply an air/fuel combustion mixture to engine 10 for combustion. Carburetor 20 generally includes an intake air passage or throat 22 extending therethrough from and inlet end 24 of carburetor 20 to an outlet end 26 of carburetor 20 which is in communication with combustion chamber(s) of the engine cylinder(s). Carburetor 20 additionally includes a venturi section 28 within throat 22 at which fuel from fuel bowl 30 of carburetor 20 is drawn into the stream of intake air which passes through throat 22 in a known manner to form an air/fuel combustion mixture. Carburetor 22 additionally includes a throttle valve 32 rotatably mounted within throat 22. Optionally, carburetor 22 may additionally include a rotatable choke valve (not shown) upstream of throttle valve 32, which is operable in a conventional manner to selectively provide an enriched air/fuel mixture to aid in cold starts of engine 10.

Engine 10 additionally includes a governor device for regulating and/or maintaining a set running speed of engine 10 in the manner described in further detail below. The governor device of engine 10 is similar to those disclosed in U.S. Pat. Nos. 4,517,942 and 5,163,401, assigned to the assignee of the present invention, the disclosures of which are expressly incorporated herein by reference. The governor device includes a governor mechanism 34 disposed within crankcase 12 and including governor gear 36 rotatably mounted upon shaft 38 and driven from drive gear 40 of crankshaft 16. Alternatively, governor gear 36 could be driven from a camshaft or countershaft (not shown) of engine 10. Two or more flyweights 42 are pivotally mounted to governor gear 36, and engage a spool 44 for translating spool 44 upon shaft 38. A governor arm 46 is rotatably mounted within crankcase 12, and includes paddle 48 in engagement with spool 44, and an outer end which extends externally of crankcase 12 and is attached to governor lever 50. In operation, flyweights 42 pivot under centrifugal force responsive the speed of engine 10, thereby translating spool 44 to rotate governor arm 46 and governor lever 50 in the manner described below. For clarity, the foregoing components of governor mechanism 34 are only shown in FIG. 1.

Still referring to FIG. 1, details of primary speed control mechanism 52 will now be described. Primary speed control mechanism 52 includes many features similar to the speed control mechanism disclosed in U.S. Pat. No. 6,279,298, assigned to the assignee of the present invention, the disclosure of which is expressly incorporated herein by reference. Primary speed control mechanism 52 includes mount plate 54 secured to crankcase 12 and/or cylinder block 14 of engine 10 by suitable fasteners, for example, and includes lower and upper stops 56 and 58. A user control element, namely, primary speed control lever 60, as well as throttle actuator lever 62, are each rotatably mounted to mount plate 54 at pivot 64 via a lost motion-type connection in which primary speed control lever 60 and throttle actuator lever 62 are together movable between the positions shown in FIGS. 1 and 2, with primary speed control lever 60 movable between stops 56 and 58 to positions corresponding to engine stop and high running speed positions, respectively. Throughout the foregoing positions of primary speed control lever 60, throttle actuator lever 62 rotates therewith; however, as described in further detail below, throttle actuator lever 62 is further rotatable in a counterclockwise direction beyond the high engine speed running position of primary speed control lever 60, as shown in FIG. 3.

Primary speed control lever 60 includes handle 66, which may be made of a suitable plastic, for example, for grasping by an operator to rotate primary speed control lever 60, and additionally includes adjustment screw 68 for limiting the rotational movement of throttle actuator lever 62 to set a minimum high engine running speed. Throttle actuator lever 62 includes a first end 70 extending generally upwardly, and an opposite, second end 72 extending generally downwardly. Second end 72 is connected to a lower or central portion of governor lever 50 via link 74, and the upper end of governor lever 50 is connected via link 75 to crank arm 76 of carburetor 20, which is in turn connected via a rotatable shaft to throttle valve 32 of carburetor 20.

Engine 10 additionally includes a secondary speed control mechanism 78 for overriding a set, governed high engine running speed of primary speed control mechanism 60 in the manner described below. Secondary speed control mechanism 78 includes secondary speed control lever 80 including a lower end 82 pivotally mounted to mount plate 54, and an upper end 84. A translatable, Bowden-type cable 86 is secured at one end thereof to a central portion of secondary speed control lever 80, and at its opposite end is secured to an operator-controlled trigger mechanism 88 which includes trigger handle or bail 90 pivotally mounted to handle 18 of the implement with which engine 10 is used. Cable 86 is covered by sleeve 92 which is secured at its opposite ends to a first clamp 94 mounted to mount plate 54, and second clamp 96 mounted to handle 18 of the implement. Adjustable stop screw 98 is provided on mount plate 54 to limit rotational movement of secondary speed control lever 80.

Figure 2:
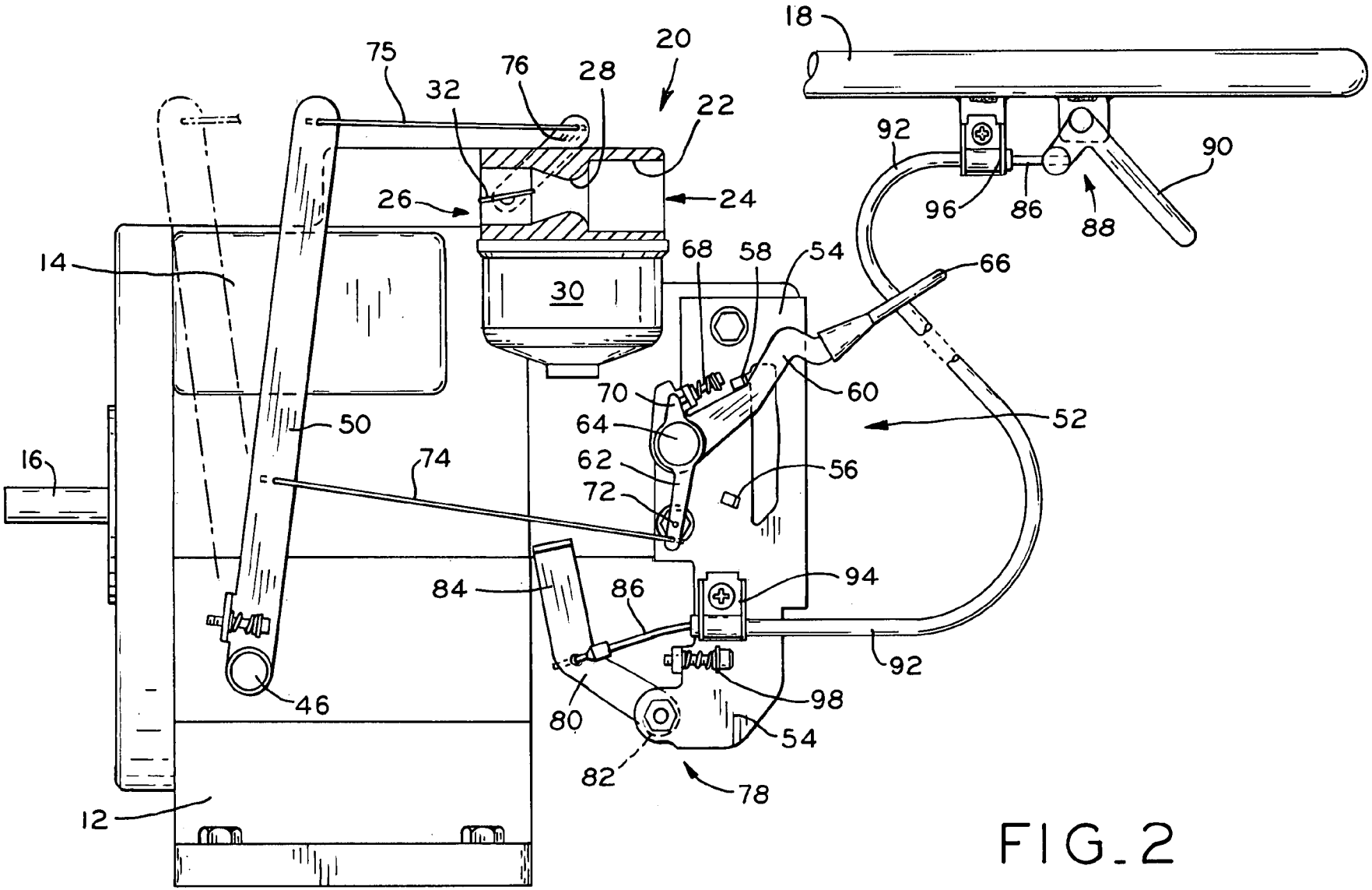
FIG. 2 is a continuation of FIG. 1, showing the primary speed control mechanism disposed in a high engine running speed position during normal operation of the engine.
Figure 3:
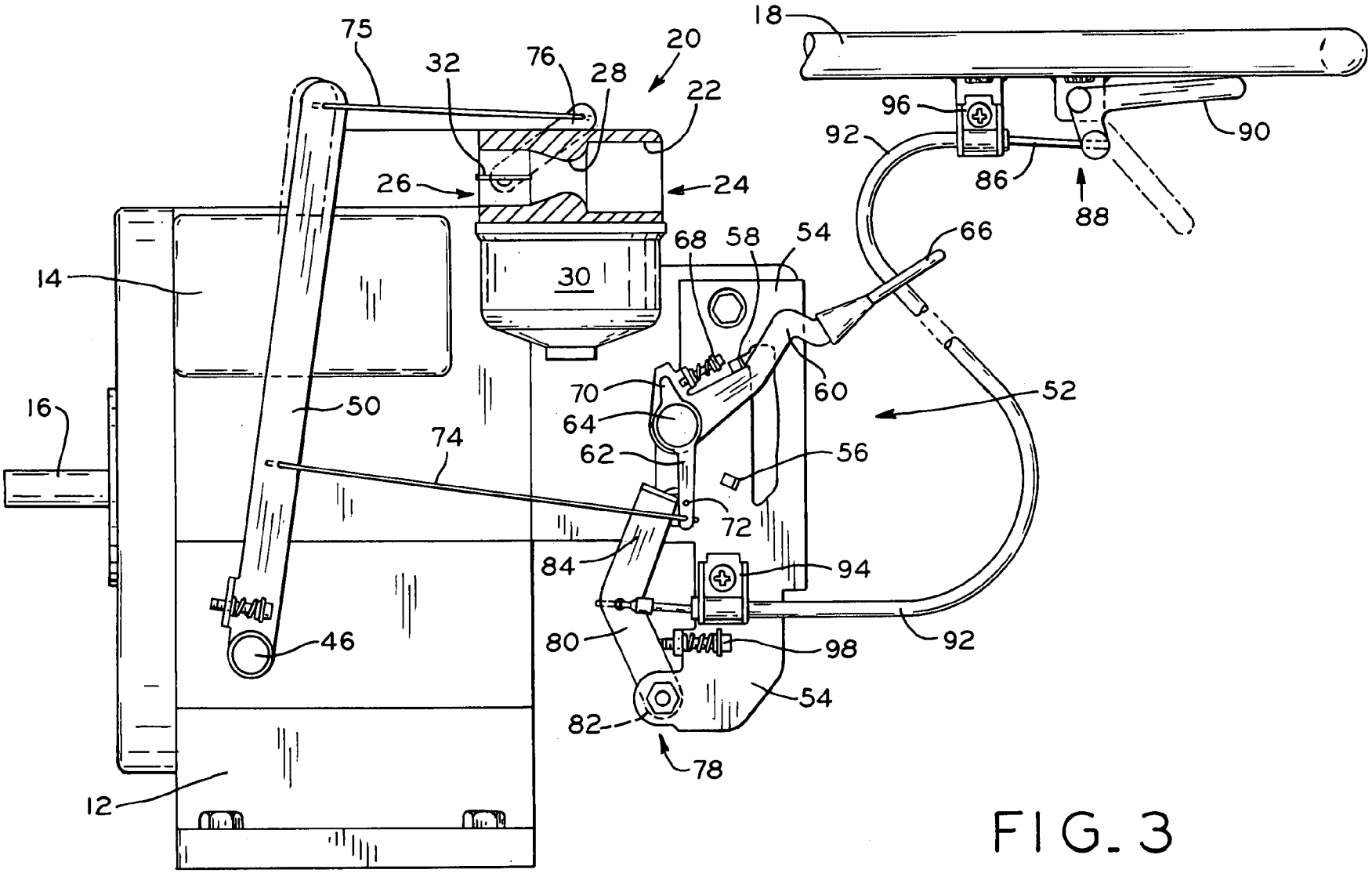
FIG. 3 is a continuation of FIG. 2, showing the primary speed control mechanism disposed in the high engine running speed position, and further showing the actuation of the secondary speed control mechanism to override the primary speed control mechanism to increase the engine running speed.

Referring to FIGS. 1–3, operation of primary speed control mechanism 52 and secondary speed control mechanism 78 will now be described. In FIG. 1, primary speed control mechanism 52 is shown with primary speed control lever 60 in an engine stop position corresponding to engine 10 being stopped. In this position, primary speed control lever 60 is rotated downwardly or clockwise to its furthest extent, engaging lower stop tab 56 of mount plate 54. Throttle actuator lever 62, link 74, governor lever 50, link 75, crank arm 76, and throttle valve 32 are each disposed such that throttle valve 32 is positioned in a substantially closed position within throat 22 of carburetor 20 wherein air flow through throat 22 of carburetor 20 into engine 10 is substantially blocked. When an operator desires to start engine 10, the operator moves primary speed control lever 60 slightly upwardly or counterclockwise in FIG. 1 to an idle position (not shown) to slightly open throttle valve 32 via the foregoing linkage. The operator then actuates a pull-type recoil starting mechanism (not shown) or an electric starter motor (not shown) to crank engine 10, thereby drawing intake air around throttle valve 32 through throat 22 of carburetor 20 to mix with fuel for starting engine 10.

Optionally, the operator may actuate a primer mechanism (not shown) associated with carburetor 20 to supply an amount of priming fuel to throat 22 of carburetor 20 to aid in starting engine 10.

After the engine starts, the operator moves primary speed control lever 60 upwardly or counterclockwise from the idle position to a desired engine running speed position, which is shown in FIG. 2 as a high engine running speed position in which primary speed control lever 60 contacts upper stop tab 58 of mount plate 54. For small internal combustion engines, normal high engine running speeds are typically between 1600 and 4000 rpm. Optionally, the operator may desire a slower engine running speed in which primary speed control lever 60 is spaced below upper stop tab 58 of mount plate 54. In the high engine running speed position of primary speed control lever 60 shown in FIG. 2, throttle actuator lever 62, link 74, governor lever 50, link 75, crank arm 76, and throttle valve 32 are positioned such that throttle valve 32 is in a substantially open position within throat 22 of carburetor 20, allowing a relatively large degree of intake air flow through carburetor 20 to allow engine 10 to run at a high speed.

In this condition, the high engine running speed is maintained by the governor device as follows. For example, when a load is placed upon engine 10, such as by the implement contacting thick snow or tall grass when engine 10 is used in a snow thrower or lawnmower application, respectively, the engine speed decreases, and flyweights 42 of governor mechanism 34 rotate inwardly with respect to one another, allowing translation of spool 44 and rotating governor arm 46 and governor lever 50 slightly in a clockwise direction from the position of governor lever 50 which is shown in solid lines in FIG. 2 (see FIG. 3). The foregoing rotation of governor lever 50 will translate link 74 to rotate throttle actuator lever 62 slightly in a counterclockwise direction such that first end 70 of throttle actuator lever 62 rotates away from stop screw 68. Concurrently, the foregoing rotation of governor lever 50 translates link 75 and crank arm 76 to rotate throttle valve 32 to its fully open position, temporarily allowing a greater amount of air/fuel combustion mixture into the engine to restore the engine's running speed. Thereafter, when the load is removed from the engine, the foregoing components operate in a reverse manner to position same in the position shown in solid lines in FIG. 2 to return the engine speed to the set high running speed. In this manner, the governor device operates to maintains the high running speed of engine 10 which is set by primary speed control mechanism 52.

Notwithstanding the operation of the governor device, there may be circumstances wherein the operator wishes to quickly increase or "boost" the speed of engine 10 beyond the high engine running speed which is set by primary speed control mechanism 52, such as when the operator anticipates an increased load which may be imposed upon engine 10. In particular, the operator may desire to increase the engine speed before the load is imposed upon engine 10 so that the operator need not wait for the governor to correct for an engine underspeed caused by the increased load. For example, when operating engine 10 in a snow thrower application, the operator may anticipate encountering thick snow and desire to quickly increase the engine speed above the set high engine running speed to a maximum speed to accommodate the increased load. In another example, an operator of a lawnmower including engine 10 may anticipate encountering tall or thick grass, and may desire to quickly increase the running speed of engine 10 above the set high engine running speed to a maximum speed to accommodate the increased load.

When the operator desires to increase the engine speed above the set high engine running speed, the operator actuates trigger handle 90 of trigger mechanism 88 to rotate same from the position shown in FIG. 2 to the position shown in FIG. 3. The foregoing translates cable 86 to in turn rotate secondary speed control lever 80 from the position shown in FIG. 2 to the position shown in FIG. 3, in which upper end 84 of secondary speed control lever 80 engages lower end 72 of throttle actuator lever 62 to rotate same in a counter clockwise direction, as shown between FIGS. 2 and 3. The foregoing rotation of throttle actuator lever 62 translates link 74 to move governor lever 50 from the position shown in solid lines in FIG. 2, and in dashed lines in FIG. 3, to the position shown in solid lines in FIG. 3, in turn translating link 75 and rotating crank arm 76 to move throttle valve 32 to its fully open position to increase or "boost" the running speed of engine 10 above its high running speed. Typically, for small internal combustion engines such as engine 10, the foregoing provides an increase of between about 100–300 rpm above the set high engine running speed.

In this manner, secondary speed control mechanism 78 is manually operable to override the governor and primary speed control mechanism 52 for temporarily increasing the running speed of engine 10. Release of trigger handle 90 by the operator returns secondary speed control lever 80, throttle acutator lever 62, governor lever 50, and the rest of the associated linkage to the position shown in FIG. 2 to allow engine 10 to run to the set high engine running speed which is set by primary speed control mechanism 52. Referring to FIG. 1, secondary speed control lever 80 may optionally be shaped such that, when primary speed control lever 60 is disposed in the engine stop or idle positions, upper end 84 of secondary speed control lever 80 will clear and not engage lower end 72 of throttle actuator lever 62 upon actuation of secondary speed control mechanism 78 in the manner described above. Thus, secondary speed control mechanism 78 may optionally be configured to only operate when primary speed control lever 60 is in its high engine running speed position.

Figure 4:
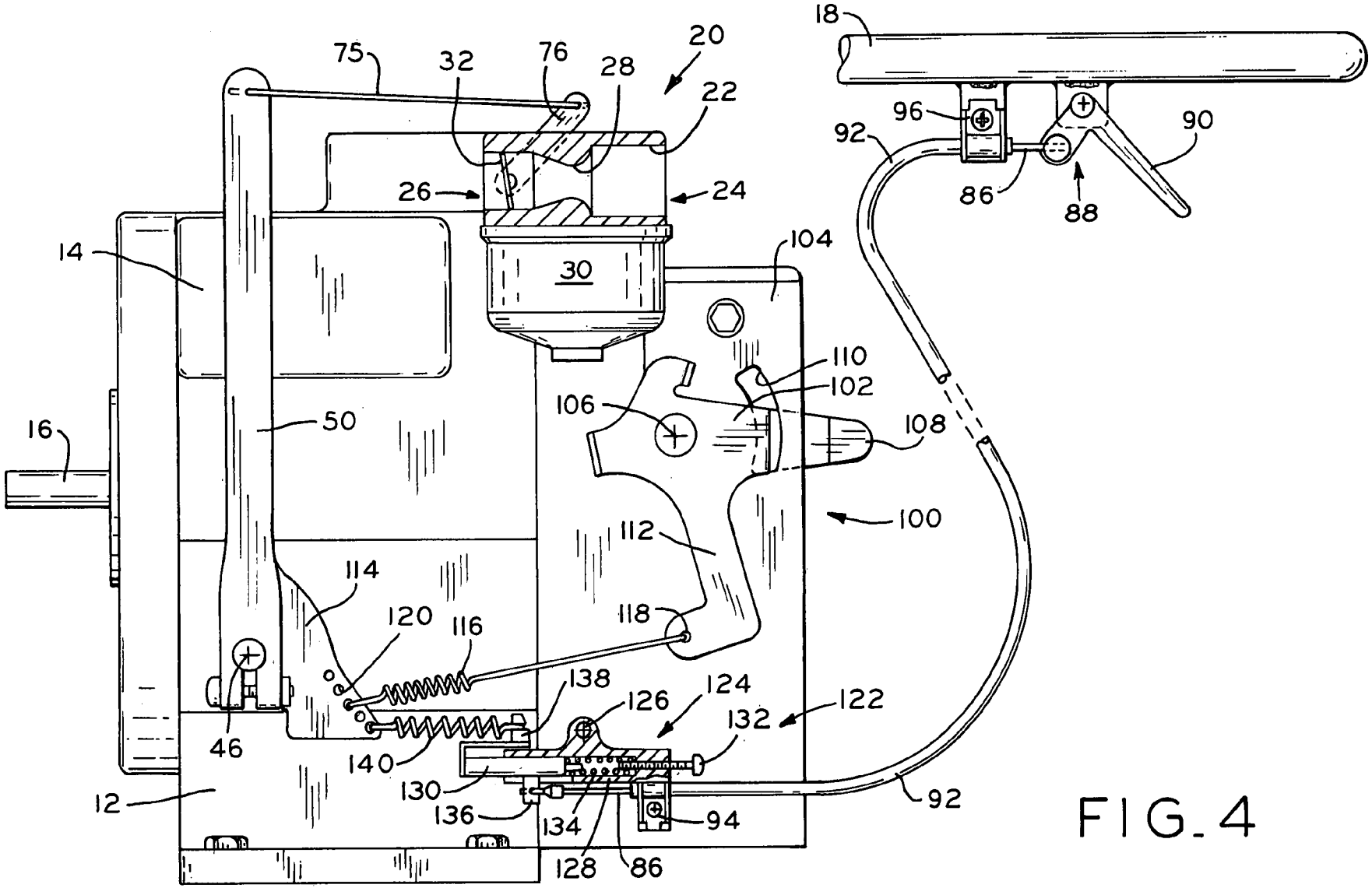
FIG. 4 is a perspective view of portions of a small internal combustion engine showing a primary speed control mechanism operably linked to the governor lever and carburetor of the engine and disposed in an engine stop position, and further showing a secondary speed control mechanism according to a second embodiment of the present invention, the secondary speed control mechanism in a non-actuated position.
Figure 5:
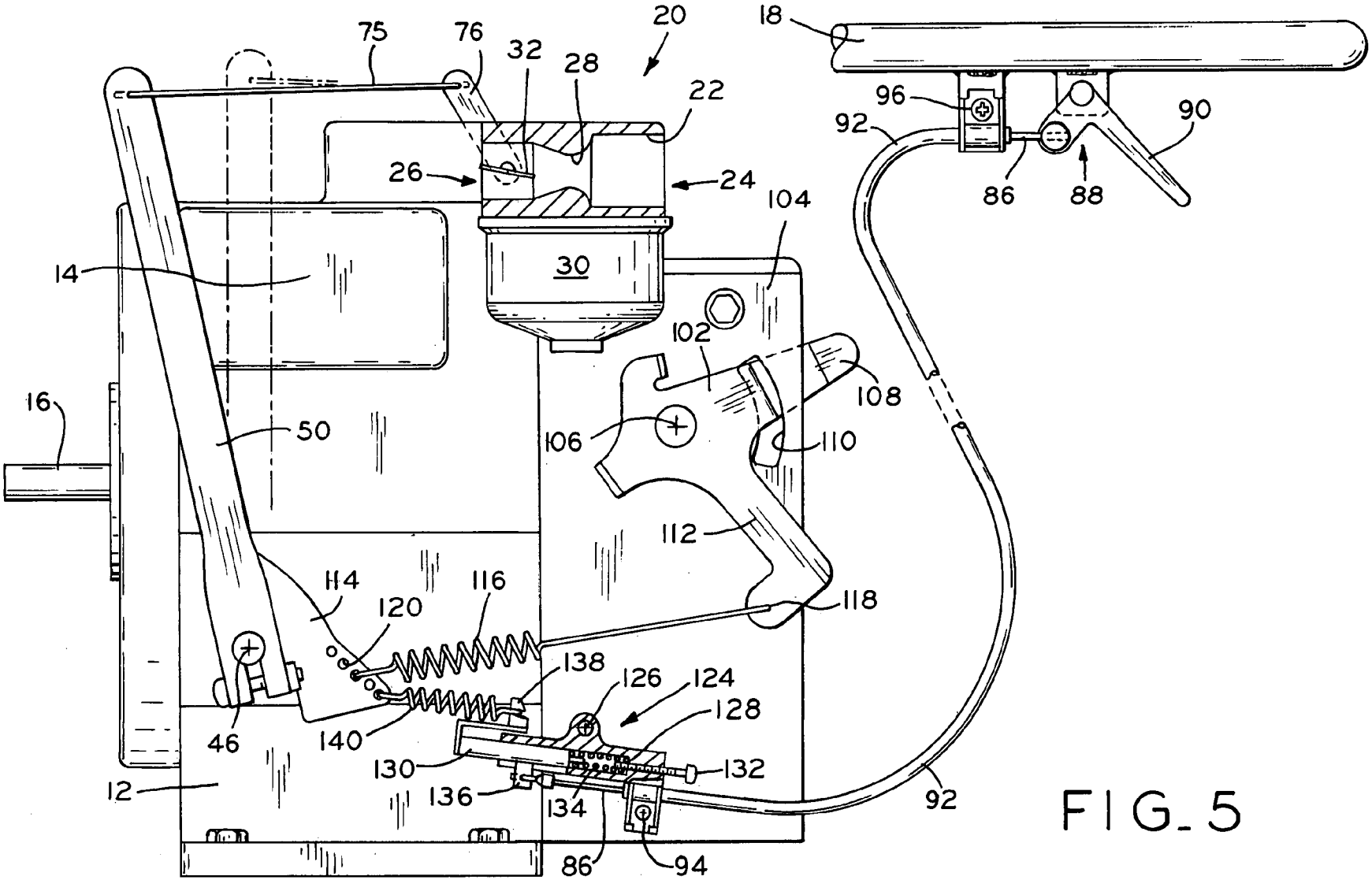
FIG. 5 is a continuation of FIG. 4, showing the primary speed control mechanism disposed in a high engine running speed position during normal operation of the engine.
Figure 6:
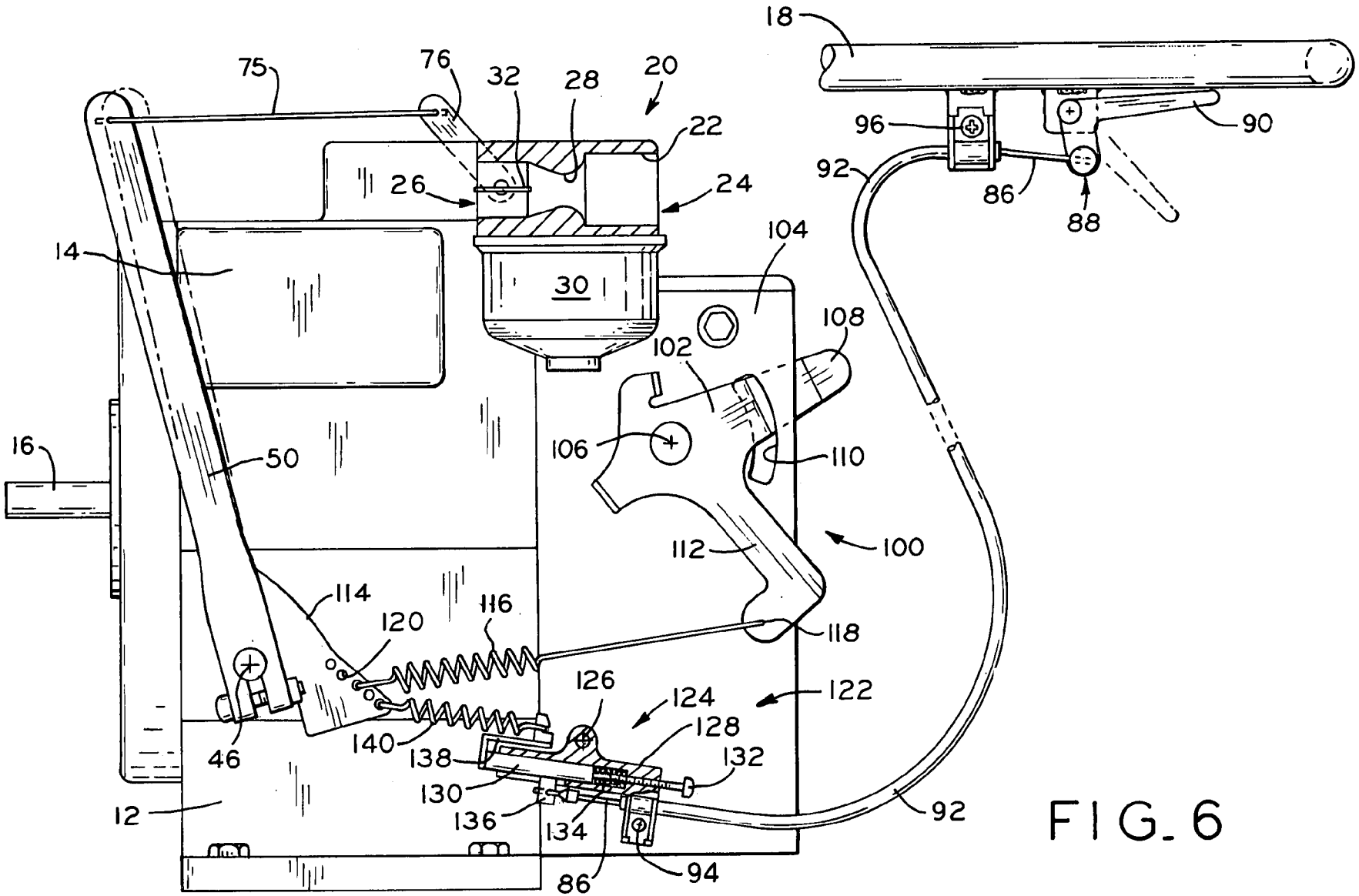
FIG. 6 is a continuation of FIG. 5, showing the primary speed control mechanism disposed in a high engine running speed position, and further showing actuation of the secondary speed control mechanism to override the primary speed control mechanism to increase the engine running speed.

A secondary speed control mechanism according to a second embodiment of the present invention is shown in FIGS. 4–6. The embodiment of FIGS. 4–6 includes several components which are identical to those of FIGS. 1–3, and identical reference numerals have been used to indicate identical or substantially identical components therebetween.

Referring to FIG. 4, engine 10 includes primary speed control mechanism 100 including primary speed control lever 102 attached to mount plate 104 of engine 10 at pivot 106, which includes handle 108 extending through slot 110 in mount plate 104. Handle 108 may be grasped by an operator to move primary speed control lever 102 between a stop position, shown in FIG. 4, in which primary speed control lever 102 contacts the lower end of slot 110, and a high engine running speed position, shown in FIG. 5, in which primary speed control lever 102 contacts the upper end of slot 110. Lower arm 112 of primary speed control lever 102 is attached to flange 114 of governor lever 50 via spring link 116 connected at opposite ends thereof to hole 118 in lower arm 112 and one of a plurality of holes 120 in flange 114 of governor lever 50.

Referring to FIGS. 4 and 5, operation of primary speed control mechanism 100 is substantially similar to that of primary speed control mechanism 52 shown in FIGS. 1 and 2 and described above. In FIG. 4, primary speed control lever 102 is disposed in an engine stop position in which same contacts the lower end of slot 110, and spring link 116, governor lever 50, link 75, crank arm 76, and throttle valve 32 are positioned such that throttle valve 32 is in its substantially closed position. After the engine is started in the manner described above, primary speed control lever 102 is rotated by an operator upwardly or counterclockwise to the high engine running speed position shown in FIG. 5, in which same contacts the upper end of slot 110. In this position, primary speed control lever 102, spring link 116, governor lever 50, link 75, crank arm 76, and throttle valve 32 are positioned such that throttle valve 32 is in its substantially open position to allow engine 10 to run at high speed. Additionally, in the manner described above with reference to the embodiment of FIGS. 1–3, the governor device of engine 10, shown in FIG. 1, maintains the set high running speed of engine 10.

Referring to FIG. 4, details of secondary speed control mechanism 122 will now be described. Secondary speed control mechanism 122 generally includes an actuator device 124 mounted to the housing of engine 10 at pivot 126. Alternatively, actuator 124 may be fixedly mounted to the housing of engine 10 without altering the manner of operation of actuator 124. Actuator 124 generally includes cylinder 128 having a bore in which plunger 130 is slidably disposed. Cylinder 128 additionally includes an adjustable stop screw 132 threaded in one end thereof for limiting the maximum sliding movement of plunger 130 within cylinder 128 in an inward direction, toward the right in FIG. 4, and a spring 134 disposed within the bore of cylinder 128 normally biases plunger 130 in an outward direction of cylinder, to the left in FIG. 4. Plunger 130 includes a first flange 136 connected to an end of cable 86, and a second flange 138 connected to one end of spring link 140, with an the opposite end of spring link 140 connected to one of the plurality of holes 120 in flange 114 of governor lever 50. In FIGS. 4 and 5, secondary speed control mechanism 122 is shown in an non-actuated position.

Referring to FIGS. 5 and 6, when an operator desires to increase the running speed of engine 10 beyond the set, governed high engine running speed, the operator actuates trigger handle 90 of trigger mechanism 88 in the manner described above, thereby translating cable 86. Translation of cable 86 in turn forces plunger 130 to slide within the bore of cylinder 128 against the bias of spring 134 until plunger 130 contacts the end of stop screw 132. Sliding movement of plunger 130 stretches spring link 140 to rotate governor lever 50 slightly in a counterclockwise direction from the position shown in dashed lines in FIG. 6 to the position shown in solid lines in FIG. 6, thereby in turn translating link 75, and rotating crank arm 76 and throttle valve 32 to position throttle valve 32 in its fully open position to provide a temporary increase or a "boost" in the engine running speed. When the operator desires to return the engine speed to the governed running speed set by primary speed control mechanism 100, the operator releases trigger handle 90, and spring link 140 and spring 134 of actuator 124 return plunger 130 to the position shown in FIG. 5, allowing governor lever 50 to rotate back to the position shown in solid lines in FIG. 5.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An internal combustion engine, comprising:

an engine housing including a rotatably driven crankshaft supported therein;

a carburetor including an intake passage with a throttle valve therein, said throttle valve positionable between a substantially closed position, a substantially open position, and a fully open position;

a primary speed control mechanism including a first operator control element mechanically linked to said throttle valve, said first operator control element movable to selectively position said throttle valve between said substantially closed position and said substantially open position; and a secondary speed control mechanism including a second operator control element mechanically linked to said throttle valve, said second operator control element manually actuable to selectively position said throttle valve between said substantially open position and said fully open position.

2. The internal combustion engine of claim 1, wherein said first operator control element comprises a speed control lever disposed proximate said engine housing.

3. The internal combustion engine of claim 1, wherein said second operator control element is disposed remotely from said engine housing.

4. The internal combustion engine of claim 3, wherein said second operator control element comprises a trigger mechanism mechanically linked to said throttle valve by linkage which includes at least a cable.

5. The internal combustion engine of claim 1, wherein said secondary speed control mechanism includes a return spring biasing said second operator control element to an inactive position.

6. The internal combustion engine of claim 1, flirther comprising a governor mechanism driven from said crankshaft, including a governor lever disposed externally of said engine housing and mechanically linked to said throttle valve, said primary and secondary speed control mechanisms each independently mechanically linked to said governor lever.

7. The internal combustion engine of claim 1, further comprising a governor mechanism driven from said crankshaft, including a governor lever disposed externally of said engine housing and mechanically linked to said throttle valve, said primary speed control mechanism mechanically linked to said governor lever, and said secondary speed control mechanism selectively engageable with a component of the linkage connecting said primary speed control mechanism with said governor lever.

8. An internal combustion engine, comprising:

a crankcase;

a cylinder block attached to said crankcase;

a crankshaft rotatably supported by said crankcase;

a carburetor including an intake passage with a throttle valve, said throttle valve rotatable within said intake passage between a substantially closed position, a substantially open position, and a fully open position;

a primary speed control mechanism including a first operator control element connected to said throttle valve via mechanical linkage, said first operator control element movable to selectively position said throttle valve between said substantially closed position and said substantially open position; and manually actuable speed control override means for actuating at least some components of said mechanical linkage to selectively position said throttle valve between said substantially open position and said hilly open position.

9. The internal combustion engine of claim 8, wherein said manually actuable speed control override means includes a second operator control element disposed remotely from said engine.

10. The internal combustion engine of claim 9, wherein said second operator control element comprises a trigger mechanism mechanically linked to said throttle valve by linkage which includes at least a cable.

11. The internal combustion engine of claim 9, wherein said manually actuable speed control override means includes a return spring biasing said second operator control element to an inactive position.

12. The internal combustion engine of claim 8, further comprising a governor mechanism driven from said crankshaft, including a governor lever disposed externally of said crankcase and mechanically linked to said throttle valve, and said primary speed control mechanism and said manually actuable speed control override means are one of:

independently linked to said governor lever; and linked to said governor lever wherein said primary speed control mechanism is directly linked to said governor lever and said manually actuable speed override means is selectively engageable with said primary speed control mechanism.

13. The internal combustion engine of claim 8, wherein said first operator control element comprises a speed control lever disposed proximate said engine housing.

14. An internal combustion engine, comprising:

an engine housing including a crankcase and a cylinder block;

a crankshaft rotatably supported by said crankcase;

a carburetor including an intake passage with a throttle valve therein;

a governor mechanism driven from said crankshaft, including a governor arm disposed externally of said engine housing and mechanically linked to said throttle valve, said governor arm and said throttle valve positionable between a first position in which said throttle valve is substantially closed, a second position in which said throttle valve is substantially open, and a third position in which said throttle valve is fully open;

a primary speed control mechanism including a first operator control element mechanically linked to said governor arm by primary linkage, said first operator control element movable to selectively position said governor arm and throttle valve between said first position and said second position; and a secondary speed control mechanism including a second operator control element mechanically linked to an actuator by secondary linkage, said second operator control element manually actuable to engage said actuator with said primary speed control mechanism to selectively position said governor arm and throttle valve between said second position and said third position.

15. The internal combustion engine of claim 14, wherein said second operator control element is disposed remotely from said engine.

16. The internal combustion engine of claim 15, wherein said second operator control element comprises a trigger mechanism mechanically linked to said throttle valve by linkage which includes at least a cable.

17. The internal combustion engine of claim 15, wherein said secondary speed control mechanism includes a return spring biasing said second operator control clement to an inactive position.

18. The internal combustion engine of claim 14, wherein said first operator control element comprises a speed control lever disposed proximate said engine housing.

19. An internal combustion engine, comprising:

an engine housing including a crankcase and a cylinder block;

a crankshaft rotatably supported by said crankcase;

a carburetor including an intake passage with a throttle valve therein;

a governor mechanism driven from said crankshaft, including a governor arm disposed externally of said engine housing and mechanically linked to said throttle valve, said governor arm and said throttle valve positionable between a first position in which said throttle valve is substantially closed, a second position in which said throttle valve is substantially open, and a third position in which said throttle valve is fully open;

a primary speed control mechanism including a first user control element mechanically linked to said governor arm, said first operator control element movable to selectively position said governor arm and said throttle valve between said first position and said second position; and a secondary speed control mechanism including a second user control element mechanically linked to said governor arm independently of said primary speed control mechanism, said second operator control element manually actuable to selectively position said governor arm and said throttle valve between said second position and said third position.

20. The internal combustion engine of claim 19, wherein said second operator control element is disposed remotely from said engine.

21. The internal combustion engine of claim 20, wherein said second operator control element comprises a trigger mechanism mechanically linked to said throttle valve by linkage which includes at least a cable.

22. The internal combustion engine of claim 20, wherein said secondary speed control mechanism includes a return spring biasing said second operator control element to an inactive position.

23. The internal combustion engine of claim 19, wherein said first operator control element comprises a speed control lever disposed proximate said engine housing.

* * * * *

UNITED STATES PATENT AND TRADEMARK OFFICE

CERTIFICATE OF CORRECTION

PATENT NO. : 7,165,532 B2
APPLICATION NO. : 11/014499
DATED : January 23, 2007
INVENTOR(S) : Kevin D. Steffes et al.

It is certified that error appears in the above-identified patent and that said Letters Patent is hereby corrected as shown below:

Claim 6, Column 10, Line 40, delete “flirther” and insert --further--

Claim 8, Column 11, Line 6, delete “hilly” and insert --fully--

Signed and Sealed this

Twenty-fourth Day of April, 2007

JON W. DUDAS
*Director of the United States Patent and Trademark Office*